US005475992A

United States Patent [19]

Wiegert

[11] Patent Number: 5,475,992

[45] Date of Patent: Dec. 19, 1995

[54] EQUIPMENT FOR TEXTILE SURFACE-TREATMENT

[75] Inventor: Susanne Wiegert, Hanover, Germany

[73] Assignee: Wiegert Textilhandel GmbH, Hanover, Germany

[21] Appl. No.: 278,977

[22] Filed: Jul. 21, 1994

[30] Foreign Application Priority Data

Jul. 22, 1993 [DE] Germany ..... 43 24 624.9

[51] Int. Cl.[6] ..... D06F 17/06

[52] U.S. Cl. ..... 68/29; 68/54; 68/131

[58] Field of Search ..... 68/28, 29, 30, 68/54, 131, 132

[56] References Cited

U.S. PATENT DOCUMENTS

| | | | |
|---|---|---|---|
| 8,921 | 5/1852 | Hollingsworth | 68/29 |
| 174,747 | 3/1876 | Tarr | 68/30 X |
| 245,663 | 8/1881 | Rowley et al. | 68/29 X |
| 269,364 | 12/1882 | Winters | 68/29 |
| 383,683 | 5/1888 | Allen | 68/30 |
| 1,253,536 | 1/1918 | Schneider | 68/131 X |
| 1,760,218 | 5/1930 | Thibault et al. . | |

FOREIGN PATENT DOCUMENTS

| | | | |
|---|---|---|---|
| 545617 | 9/1957 | Canada | 68/131 |
| 637109 | 4/1928 | France . | |
| 3129699 | 2/1983 | Germany . | |
| 502253 | 3/1939 | United Kingdom . | |
| 1204741 | 9/1970 | United Kingdom . | |

*Primary Examiner*—Philip R. Coe
*Attorney, Agent, or Firm*—Longacre & White

[57] ABSTRACT

A method and equipment for the surface-treatment of textiles, whereby the textiles are processed by mechanically stressing their surfaces, illustratively to achieve fading/wash-out effects, thereby simulating substantial wear of a garment, additional waste removal being minimized. A liquid-holding container is provided to receive the textiles being treated, with wooden bodies being present in the liquid and evincing such a density that either they float at the surface and/or within the liquid. An agitator keeps the textiles being treated in motion inside the liquid and between the wood bodies.

17 Claims, 1 Drawing Sheet

EQUIPMENT FOR TEXTILE SURFACE-TREATMENT

BACKGROUND OF THE INVENTION

1. Field of the Invention

The invention concerns a method for textile surface-treatment wherein the textiles are mechanically stressed at their surface in order to achieve fading/wash-out effects, that is, the invention effects simulated wear of a textile garment.

2. Description of the Related Art

In known processing of textiles, the textiles being treated are pulled in-line though equipment to be processed by means of brushes, rollers or the like to soften them.

It is further known to add freely moving pumice stones to the wash water of textiles to act on the latter while being moved jointly with said textiles and water during washing, and so acting on the textile surface, the textiles are beaten and thereby are made soft.

These known procedures incur the drawback that the pumice stones are abraded during washing and therefore a slurry consisting of pumice-stone abrasion and textile abrasion is created. Such a slurry must be removed and thereby additional cost and labor is entailed.

SUMMARY OF THE INVENTION

It is the object of the present invention to create a method and equipment for textile surface-treatment whereby additional waste removal is minimized.

The above noted problems in the prior art are solved by the invention which provides a liquid-holding container receiving the textiles to be treated, wood bodies being present in the container and being of such density that they shall float either at the surface and/or at a lower liquid level. An agitator is provided to circulate the textiles being treated through the water and between the wood bodies.

As a result the treated textiles are treated during their motion in the water and thereby their surface is softened without creating an abrasion slurry. It was found in surprising manner that wood bodies will not suffer significant abrasion in the method used herein. Instead they survive the particular textile treatments practically free of abrasion. Moreover the beating of the textiles is comparatively gentle when performed by the wood bodies and the surface abrasion of these textiles also is minimized, as a result of which for practical purpose waste removal can be eliminated. Nevertheless the fading/wash-out effect of the invention which simulates wear of the garment surprisingly is substantially the same as that produced by pumice stones.

It is noted that the geometric shape of the wood bodies may vary. For instance, the wood bodies may assume the form of blocks such as cubes, parallelipipeds or the like, and also of spheres.

An agitator of the invention is especially advantageous, comprising a driven shaft with a multi-blade impeller near the upper container edge. In the preferred embodiment, at least two blades are provided and comprising rounded edges. Such an agitator keeps both the water and the floating bodies circulating.

Moreover, the textile being processed is preferably pulled by the impeller blades along an approximately circular or elliptical path through the container. In this respect it is advantageous to mount the impeller blades in such manner that at least one flow constriction shall arise between an outer blade edge and the container wall with respect to the entire circulation path. The flow accelerates in this constriction to thereby accelerate the flow of the textile whereby the textile is longitudinally aligned with the floating wood bodies.

Thereby the textiles are processed in the warp-direction. Disadvantageous processing in the filling direction is avoided.

It was found especially advantageous that the horizontal container cross-section be approximately oval or elliptical, in any event rounded omnidirectionally when seen in top-view, and that the impeller comprise four blades, with those opposite one another being in the same plane. The impeller blades are unilaterally offset to one side in the direction of the container wall. This unilateral offset produces the above flow constriction and the hydrodynamic shape of the impeller blades to make them plane at the top, that is not curved, as a result of which and as already mentioned, the particular opposite blades will be in one plane. This is especially advantageous for the case of four blades which are mounted in offset manner on the drive shaft in such a way that, together with the container wall, they form on one side the above described flow constriction. The blades may be reinforced at least at the affixing zone to the shaft, such reinforcements being present on the blade downstream sides of the circulation path.

Appropriately the water surface is below the shaft so that only the impeller blades, not the shaft and/or its bearings may be immersed. Thereby the force delivered by the blades is fully transmitted to the water and to the wood bodies floating therein.

The invention is elucidated below by means of illustrative embodiments shown in the drawing. It is noted that the drawings are not intended to limit the spirit and scope of the invention but are provided for purposes of illustration only.

DETAILED DESCRIPTION OF THE PREFERRED EMBODIMENT

Figure 1:
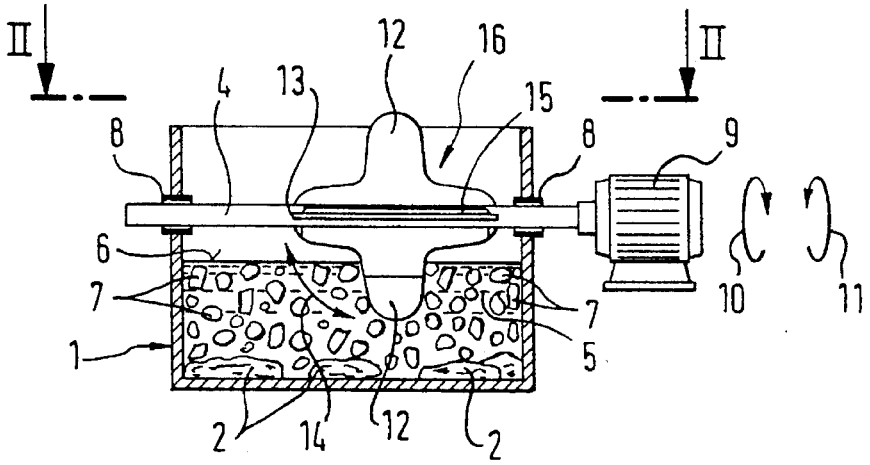
FIG. 1 is a side view of the preferred embodiment of the equipment of the invention taken along section line I—I of FIG. 2.

As shown by FIG. 1, a container 1 is provided that receives the textiles 2 to be treated (also see FIG. 2), wherein the container 1 is partially filled with water or other suitable liquid 5 to a level almost reaching a shaft 4 defined by the water surface 6. Preferably the shaft 4 is provided above the water surface 6 so as not to become immersed therein.

Wood bodies 7 are present in the water 5 and evince such a density that either they shall float at the water surface 6 or at a lower level inside this water 5.

The shaft 4 is rotatably supported at opposite sides of the container 1 by bearings 8 and is driven by a motor 9 in the direction of the arrow 10.

In the embodiment of FIG. 1, four impeller blades 12 and 13 are affixed at 90° from one another to the shaft 4, rotating together with said shaft and being pulled through the water 5. Accordingly they are able to rotate back and forth in the direction of the double arrow 14 of FIG. 1.

Thus the blades 12 and 13 together with the fitting 15 to the shaft 4 form an agitating impeller 16, the individual blades 12 and 13 evincing rounded edges in order not to damage the textiles while nevertheless driving them through the water 5.

Figure 2:
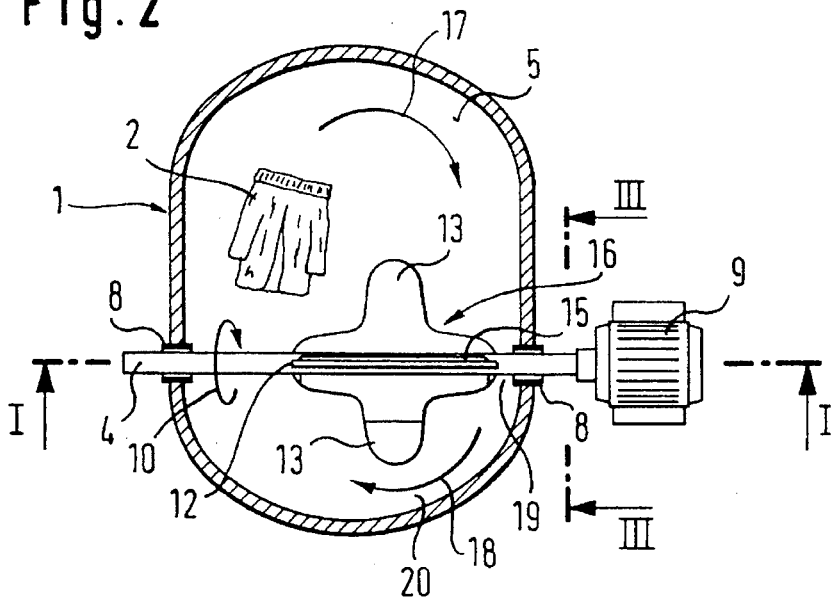
FIG. 2 is the topview of the embodiment of FIG. 1 taken along section line II—II of FIG. 1.

FIG. 2 is the topview of the embodiment of FIG. 1 with the wood bodies in the water 5 being omitted for the sake of clarity. As shown by FIG. 2, the impeller 16 is offset in such manner inside the container 1 that at least one flow constriction 19 is created with the container wall, wherein the flow represented by the arrows 17 and 18 will be accelerated. Where appropriate, furthermore, and as shown in FIG. 2, additional flow constrictions may also be provided at other locations in the circulation path; preferably a flow constrictions 20 is provided downstream of flow constriction 19. As a rule however the desired effect is achievable with merely one flow constriction.

As further shown by FIG. 2, an approximately oval or elliptical shape of the container 1 will be appropriate to achieve a suitable flow or circulation.

Figure 3:
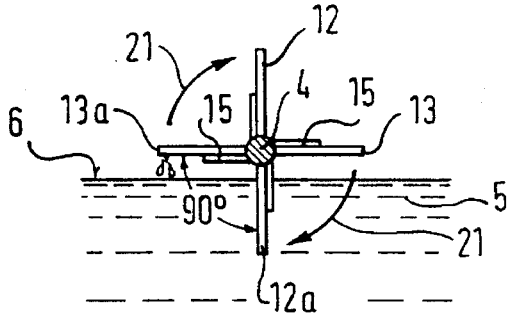
FIG. 3 is the front view of the impeller blades partially immersed in liquid taken along section line III—III of FIG. 2 wherein the container is omitted.

FIG. 3 is the front view of the embodiment of FIG. 2 taken along section line III—III with the container being omitted. As shown by FIG. 3, the impeller blades 12 and 12*a* are opposite and in a common plane. This is also the case for the two opposite agitator blades 13 and 13a, the two common planes being preferably perpendicular to one another.

FIG. 3 also shows a cross-section of the shaft 4 and of the reinforced fittings 15 affixing the blades 12 and 13 to the shaft 4. In the embodiment mode shown in FIG. 3, the shaft 4 rotates in the direction of the arrows 21, wherein the agitator blades dip like paddles into the water 5 (FIG. 1) during this rotation and are lifted out upon reaching horizontal position. The blade 13*a* shown on the left in FIG. 3 has just been lifted out of the water 5 whereas the blade 12*a* shown at the bottom of FIG. 3 transmits all of its force to the water in the position shown in FIG. 3.

While the invention has been shown and described with reference to the accompanying drawings it will be understood by those of skill in the art that various changes in form and details may be made therein without departing from the spirit and scope of the invention.

I claim:

1. Equipment for the surface treatment of textiles, whereby the textiles are processed in order to achieve fading/wash-out effects which simulates wear of said textiles, said equipment comprising:

a container means for holding a liquid and for receiving said textiles;

a plurality of wooden bodies provided in the liquid, said wooden bodies being adapted to float in said liquid, and an agitator means for circulating the textiles in the liquid and among the plurality of wooden bodies;

wherein the agitator means comprises a multi-blade impeller mounted on a drive shaft, said drive shaft passing through an upper portion of said container, said impeller being located adjacent an inner wall of said container to define at least one flow constriction therebetween, and wherein said textiles pass between said impeller and said inner wall through said constriction during surface treatment.

2. The equipment defined in claim 1, wherein the wooden bodies are cubic in shape.

3. The equipment defined in claim 1, characterized in that the wooden bodies are spherical.

4. The equipment defined in claim 1, wherein said impeller comprises at least two oppositely opposed blades lying in a first plane and evincing rounded edges.

5. The equipment defined in claim 1, wherein the wooden bodies are kept in motion by the rotation of the impeller through the liquid.

6. The equipment defined in claim 1, wherein the textiles are circulated by the impeller along a circulation path through the container.

7. The equipment defined in claim 1, wherein the textiles are processed in the direction of a plurality of warps forming said textiles.

8. The equipment defined in claim 1, wherein a horizontal cross-section of the container means defines an oval or elliptical shape.

9. The equipment defined in claim 8, wherein the at least one flow constriction accelerates a flow in said liquid whereby the textiles are aligned longitudinally with the floating wooden bodies.

10. The equipment defined in claims 1, wherein the agitator means comprises four blades which are pairwise opposite and in the same plane.

11. The equipment defined in claim 10, wherein the four blades are unilaterally offset toward one side of a container inside wall.

12. The equipment defined in claim 1, wherein the agitator means comprises blades which are planar.

13. The equipment defined in claim 1, wherein said agitator means comprises four agitator blades mounted on a drive shaft in an offset manner with respect to said inner wall so as to form said at least one flow constriction.

14. The equipment defined in claim 1, wherein the agitator means comprises agitator blades mounted to a drive shaft at a mounting site and fitted with reinforcements at least at said mounting site.

15. The equipment defined in claim 14, characterized in that the reinforcements are mounted on a downstream side of the agitator blades with respect to a circulation of said liquid.

16. The equipment defined in claim 1, wherein the drive shaft is rotatably mounted on said container means through bearing means, and said agitator blades are raised above an upper surface of said liquid whereby the agitator blades are adapted to dip into the liquid, said drive shaft and bearing means being maintained above said upper surface so as not to contact said liquid.

17. The equipment defined in claim 1, wherein the wooden bodies are shaped as parallelipipeds.

* * * * *